US006024177A

United States Patent [19]

Winebrenner

[11] Patent Number: 6,024,177

[45] Date of Patent: Feb. 15, 2000

[54] SPRINKLER HEAD ESCUTCHEON LOCKING RING

[75] Inventor: Thomas E. Winebrenner, Hastings, Mich.

[73] Assignee: The Viking Corporation, Hastings, Mich.

[21] Appl. No.: 09/112,111

[22] Filed: Jul. 8, 1998

[51] Int. Cl.[7] ..... A62C 25/00

[52] U.S. Cl. ..... 169/51; 169/37; 411/144; 411/160; 411/544

[58] Field of Search ..... 169/37, 51; 239/288; 411/143, 144, 145, 146, 147, 160, 544

[56] References Cited

U.S. PATENT DOCUMENTS

| | | | |
|---|---|---|---|
| Re. 17,396 | 8/1929 | Adams | 411/143 |
| 269,412 | 12/1882 | Heaton | 411/144 |
| 402,054 | 4/1889 | Bay | 411/144 |
| 1,010,391 | 11/1911 | Lambie et al. | 411/144 |
| 1,033,585 | 7/1912 | Hickey et al. | 411/144 |
| 1,063,211 | 6/1913 | Pisor | 411/144 |
| 1,749,600 | 3/1930 | Olson | 411/144 |
| 1,836,528 | 12/1931 | Dyson | 169/37 |
| 2,370,912 | 3/1945 | Pierce | 411/144 |
| 2,531,790 | 11/1950 | Rowley | 169/37 |
| 2,534,066 | 12/1950 | Rowley | 169/37 |
| 2,765,017 | 10/1956 | Robbins | 411/160 |
| 3,389,884 | 6/1968 | Ault | 248/345 |
| 3,393,746 | 7/1968 | Hodnett | 169/37 |
| 3,727,695 | 4/1973 | Danton | 169/37 |
| 4,019,582 | 4/1977 | Gangell | 169/37 |
| 4,117,887 | 10/1978 | Anderson | 169/37 |
| 4,215,751 | 8/1980 | Mears | 169/51 |
| 4,872,512 | 10/1989 | Multer | 169/51 |
| 4,926,946 | 5/1990 | Polan | 169/37 |
| 5,020,601 | 6/1991 | Retzloff et al. | 169/37 |
| 5,072,792 | 12/1991 | Simons et al. | 169/37 |
| 5,080,176 | 1/1992 | Polan et al. | 169/37 |
| 5,083,616 | 1/1992 | Polan | 169/40 |
| 5,097,906 | 3/1992 | Polan | 169/37 |
| 5,152,344 | 10/1992 | Fischer et al. | 169/37 |
| 5,447,338 | 9/1995 | Kikuchi | 285/46 |
| 5,562,378 | 10/1996 | Blechschmidt et al. | 411/160 |

*Primary Examiner*—Andres Kashnikow
*Assistant Examiner*—Jorge Bocanegra
*Attorney, Agent, or Firm*—Van Dyke, Gardner, Linn & Burkhart, LLP

[57] ABSTRACT

An escutcheon locking ring for an automatic sprinkler head having an externally threaded section with a top portion having an engaging member extending therefrom comprises a ring having a plurality of tabs extending from the inner perimeter, and an outer perimeter having a plurality of escutcheon engaging fingers depending therefrom. The escutcheon engaging fingers are curved and are formed with sharp ends. When positioned between the bottom surface of the engaging member and the escutcheon, the sharp ends of the depending escutcheon engaging fingers penetrate the surface of the escutcheon. An attempt to unscrew the escutcheon from the sprinkler head causes the rotation of the ring until frictional contact is made between the extending tabs and the engaging member. Once frictional contact is achieved, a positive lock is formed preventing one from unscrewing the escutcheon from the sprinkler head. In an alternative embodiment, the extending tabs are replaced by extending U-shaped members. The curvature of the depending escutcheon fingers enables the locking ring of the present invention to be formed from a single sheet of material.

31 Claims, 5 Drawing Sheets

SPRINKLER HEAD ESCUTCHEON LOCKING RING

BACKGROUND OF THE INVENTION

The present invention relates to sprinkler heads used in automatic fire extinguishing systems for buildings and the like, and in particular relates to a locking ring which prevents removal of an escutcheon from the sprinkler heads.

Sprinkler heads have long been used in automatic fire extinguishing systems located in various buildings in order to controllably expel a fluid from the sprinkler head in an attempt to either suppress or extinguish the fire. The automatic sprinkler head itself can assume a variety of configurations and dimensions depending on the particular manufacturer and the environment in which it is to be used. One common type of automatic sprinkler head includes a metal base threadably connected to a pipe located in the ceiling and in fluid communication with a pressurized water source, or other fire extinguishing fluid. The base is integrally attached to and in fluid communication with the interior of the sprinkler head. The interior of the sprinkler head receives a deflector plate in operational connection with a seal biased in the closed position. The deflector plate is held within the interior of the body by a pair of outwardly biased pins depending from the bottom of the sprinkler head. These pins are held in an inwardly biased position by a thermally sensitive bridge member. During normal conditions, the thermally sensitive bridge member maintains the closed position of the seal and thereby prevents water or other fluid from being emitted into the designated area.

When the designated area reaches a preselected temperature indicative of a fire, the thermally sensitive bridge member will either melt or separate, causing the inwardly biased pins to move to the outward position. This in turn causes the deflector plate to be expelled from the interior of the sprinkler head and depend a preselected distance into the designated area. This action also results in the opening of the seal permitting pressurized water to enter the interior of the sprinkler body and be expelled therefrom. Once expelled, the trajectory of the water is altered by the deflector plate in an optimum manner to thereby extinguish or suppress a fire.

When an automatic sprinkler head is positioned within the ceiling, an annulus or gap is formed between the sprinkler head and the ceiling. This annulus is formed because in order to thread the base portion of the sprinkler head to the piping, the ceiling hole must be larger than the sprinkler head. This gap or annulus is both dangerous and unattractive. As a result, it is common practice to cover the annulus by using an escutcheon. An escutcheon is a cylindrical plate having a center bore. A set of threads is formed on the inner wall of the central bore. These threads are complementary to a set of external threads formed about the exterior of the bottom of the sprinkler head. Thus, the escutcheon is screwed onto the bottom portion of the sprinkler head thereby covering the annulus between the sprinkler head and the surrounding ceiling.

In most environments, an escutcheon which is simply threadably received by the exterior surface of the sprinkler head is satisfactory. However, automatic sprinkler heads are also used in environments wherein it is necessary to take precautions against tampering. In environments such as mental health facilities, prisons and correctional facilities, and some educational facilities, individuals may unscrew the escutcheon from the sprinkler head and thereafter damage the sprinkler head itself, or cause premature expulsion of water from the sprinkler head, thereby causing property damage. Moreover, once the escutcheon is removed, it is also possible for such individuals to be harmed by contact with electrical wiring often located in proximity to the piping which supplies water to the sprinkler head.

Therefore, there exists a need for a device which locks the escutcheon to the exterior surface of the sprinkler head and hence protects the same from damage caused by unauthorized removal.

SUMMARY OF THE INVENTION

Accordingly, the present invention advances a device for providing a positive lock between the escutcheon and the sprinkler head, thereby preventing the unauthorized removal of the escutcheon once attached to the sprinkler head. According to a preferred aspect of the invention, the device is embodied in a locking ring surrounding the threaded portion of the sprinkler head which receives the escutcheon. The locking ring includes at least two tabs extending from the inner perimeter of the ring. Preferably, the tabs are formed to have sharp ends. The ring also is formed with at least two fingers depending from the outer perimeter of the ring and engaging the escutcheon surface. The depending fingers frictionally engage the escutcheon surface. Consequently, when the escutcheon is rotated in an attempt to remove it from the sprinkler head, frictional contact between the fingers and the escutcheon will cause the rotation of the locking ring so that the tabs will penetrate, or "dig" into the underside of a rim positioned above the threaded region of the sprinkler head.

In a preferred embodiment, the rim of the sprinkler head is replaced by a pair of flanges extending from the top of the threaded region. In this embodiment, an attempt to remove the escutcheon from the sprinkler affects the rotation of the locking ring such that the tabs are placed in abutting contact with the flanges. Consequently, the locking ring provides a positive lock and thus prevents one from removing the escutcheon from the head of the sprinkler.

According to another preferred aspect of the invention, the fingers depending from the outer perimeter of the ring are curved inwardly toward the center bore of the locking ring. When the locking ring is formed, it may be cut from a single sheet of material with no machining required beyond the outer perimeter. This in turn simplifies the manufacture of the locking ring, as well as reducing the amount of material required in its formation. Consequently, production costs are reduced.

According to yet another preferred aspect of the invention, the depending fingers have sharp ends designed to penetrate the surface of the escutcheon. Thus, when the tabs are in frictional contact with the rim, or abutting contact with the flanges of the sprinkler head, further attempts to unscrew the escutcheon causes the sharp ends to dig into or gouge the surface of the escutcheon and hence prohibit further rotation.

These and other features and advantages of the present invention will be further understood and appreciated by those skilled in the art by reference to the following specification, claims and drawings.

DESCRIPTION OF THE PREFERRED EMBODIMENT

Figure 6:
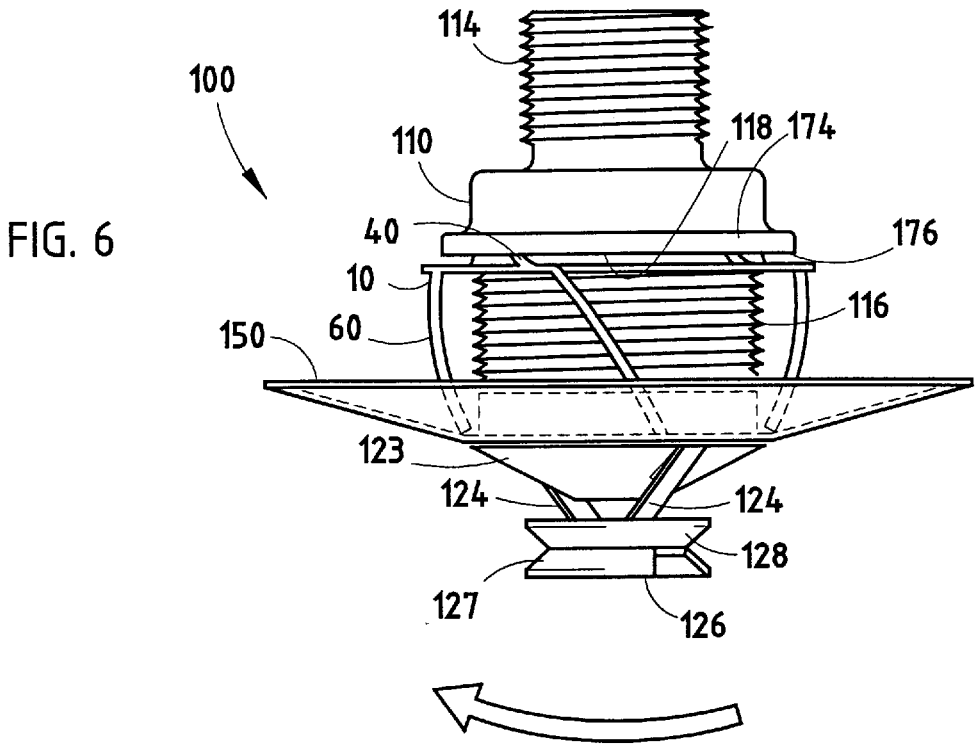
FIG. 6 is a perspective view of an escutcheon locking ring according to the present invention shown in the assembled position on a sprinkler head having a rim above the bottom threaded portion and an escutcheon shown in phantom.

The present invention is embodied in a unique sprinkler head escutcheon locking ring for an automatic sprinkler system designed to prohibit the unauthorized removal of an escutcheon from a sprinkler head. The present invention will now be described with reference to the accompanying drawings wherein like reference numerals correspond to like elements in the several drawings. Referring now to FIGS. 3–6, an automatic sprinkler head 100 normally contains a body 110 having an upper section 114. Upper section 114 is externally threaded, allowing removable attachment with the piping positioned within the ceiling (not shown). This piping is in fluid communication with a source of pressurized water or other fire extinguishing fluid. Upper section 114 is in fluid communication with the interior of body 110. The interior of body 110 supports a deflector plate and a fluid seal biased in the closed position (not shown). Body 110 also contains an externally threaded section 116. Top 118 of threaded section 116 contains a pair of flanges 120 extending horizontally therefrom. A cover 123 encloses bottom 122 of body 110 and is formed with cutout sections 115. Extending through cutout sections 115 and below bottom 122 of body 120 are a pair of arms or pins 124 in operational connection with the deflector plate and fluid seal housed within body 110. Pins 124 extend below body 110, and when sprinkler head 100 is positioned within the ceiling, pins 124 depend a preselected distance into the designated area.

Pins 124 are normally biased in an outward direction, but are held together in an inward position by a thermally sensitive trigger mechanism 126. Thermally sensitive trigger mechanism 126 receives the lower end of pins 124 and holds the same in the state of tension such that the deflector plate remains within the interior of body 110 and the fluid seal remains in the closed position, thereby preventing pressurized water or other fluid from running through the interior of body 110 and being expelled from bottom 122. Thermally sensitive trigger mechanism 126 is known in the art and generally comprises one or more plates 127 and 128 joined by a heat fusible material. Plate 127 and 128 are formed with an aperture which receives and holds the ends of pins 124 in the closed position. When the heat fusible material is subjected to a predetermined temperature, its deformation causes the release of plates 127 and 128. Upon release, pins 124 move to their outwardly biased position which opens the fluid seal and results in the expulsion of the deflector from bottom 122 of sprinkler head 100. Thereafter pressurized water or other extinguishing fluid travels through body 110 and into the designated area to extinguish a fire. It will be appreciated by those with ordinary skill the art that other commonly employed types of trigger mechanisms may be used in lieu of thermally sensitive trigger mechanism 126, without departing from the spirit and scope of the present invention.

Figure 1:
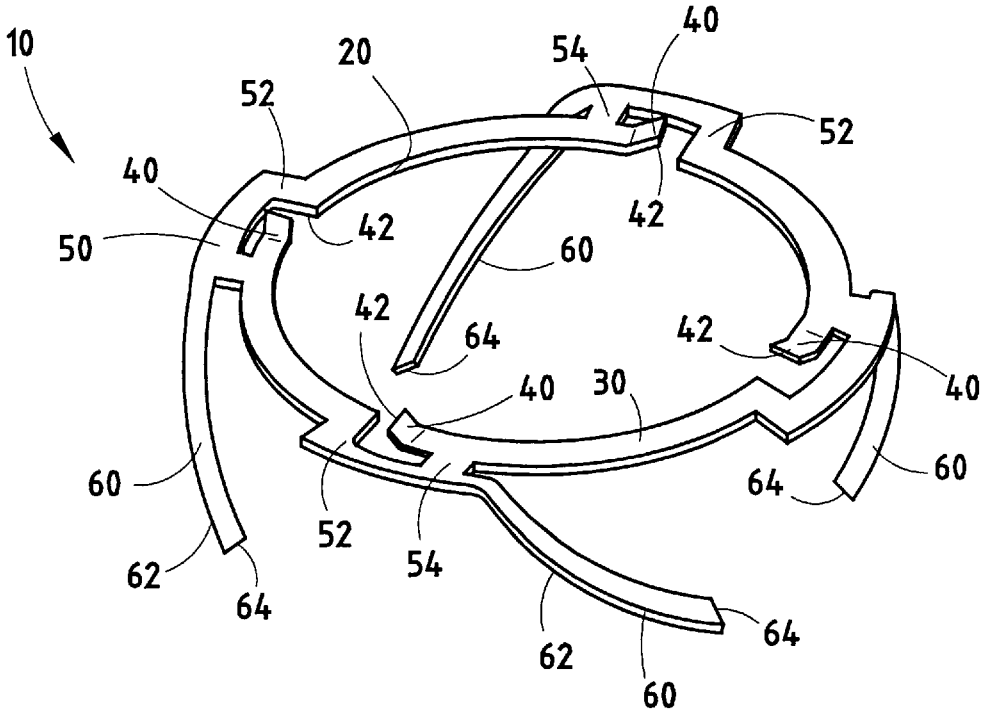
FIG. 1 is a perspective view of a sprinkler head escutcheon locking ring according to a preferred embodiment of the invention.
Figure 2:
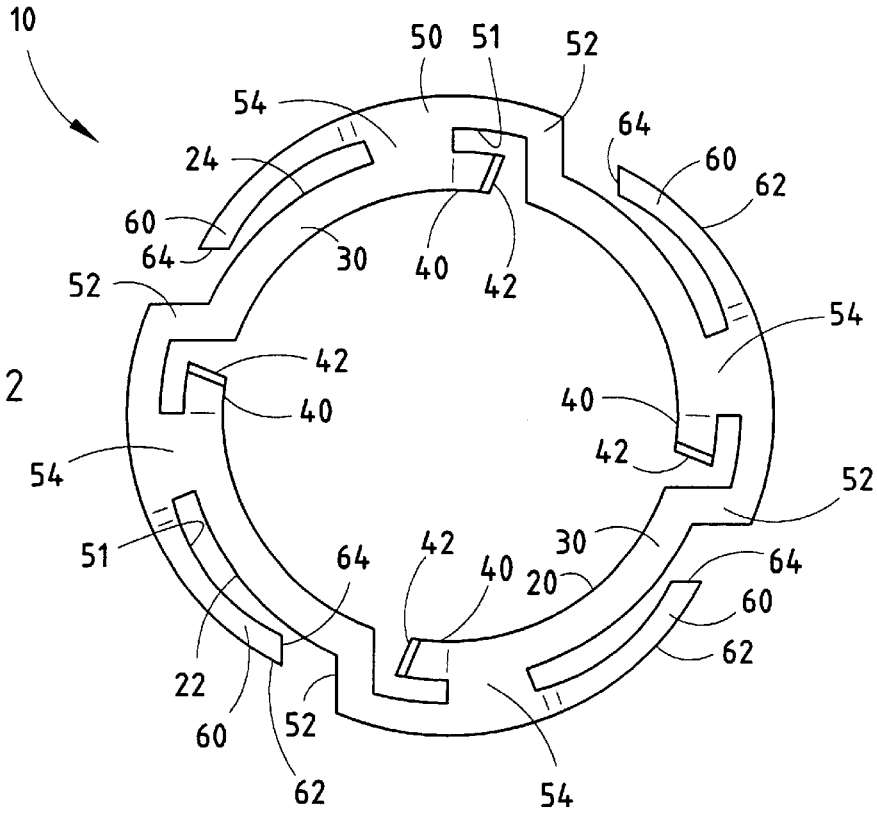
FIG. 2 is a top view of the locking ring depicted in FIG. 1.
Figure 3:
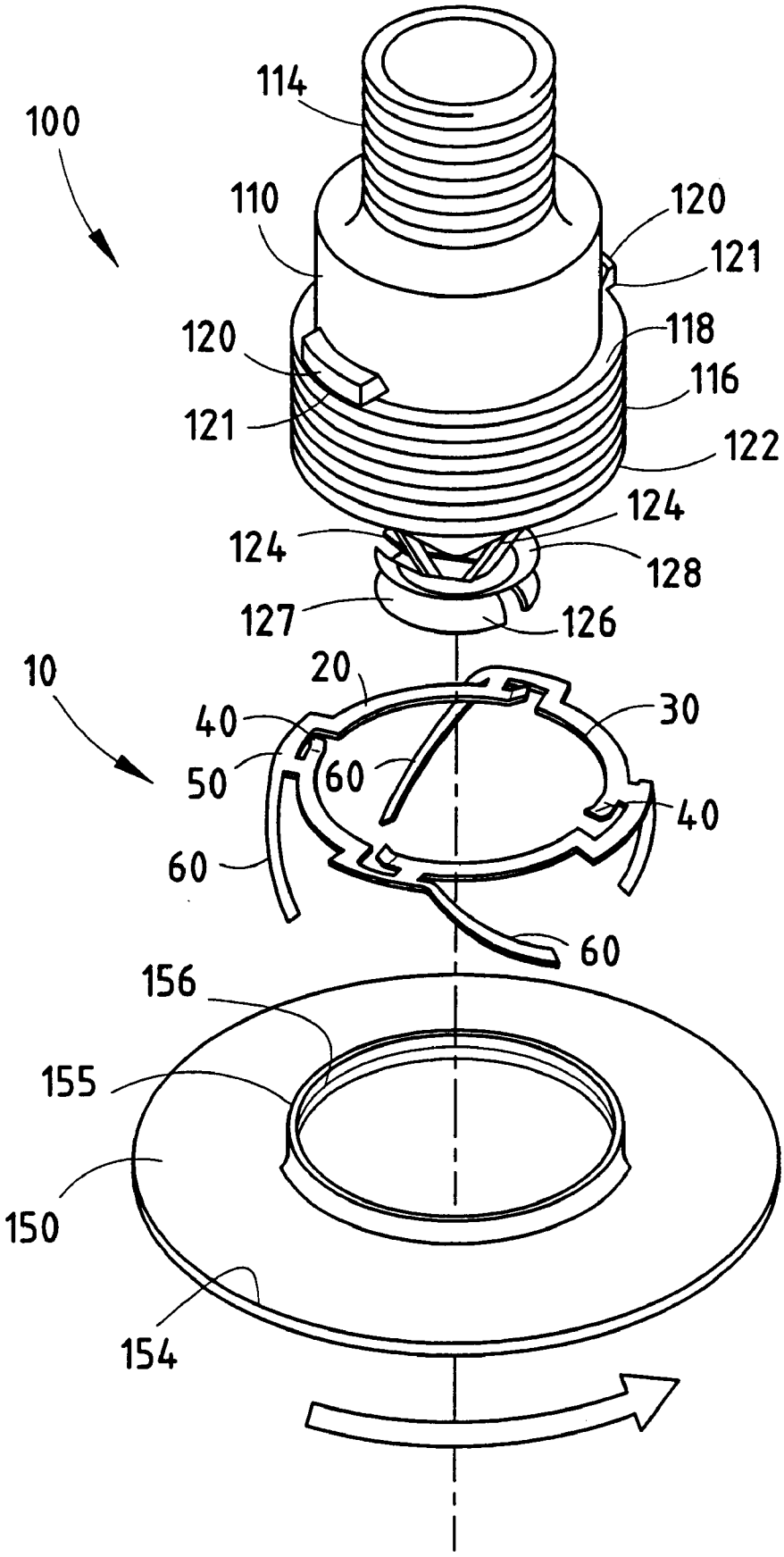
FIG. 3 is an exploded isometric view of the locking ring of FIGS. 1 and 2 depicting a sprinkler head having a pair of flanges above the bottom threaded region and an escutcheon.

Turning now to FIGS. 1 and 2 there is shown a front view and a top view of sprinkler head escutcheon locking ring, respectively, according to the present invention, and generally designated by reference numeral 10. Escutcheon locking ring 10 has an inner section 20 having a circumference sufficient to surround externally threaded portion 116 of body 110 of sprinkler head 100. Extending from top surface 30 of escutcheon locking ring 10 are a plurality of fingers or tabs 40. Preferably, there are four tabs 40 positioned at approximately 90°, 180°, 270° and 360° with respect to the center of locking ring 10. Each tab 40 is preferably formed with a sharp end 42.

Figure 7:
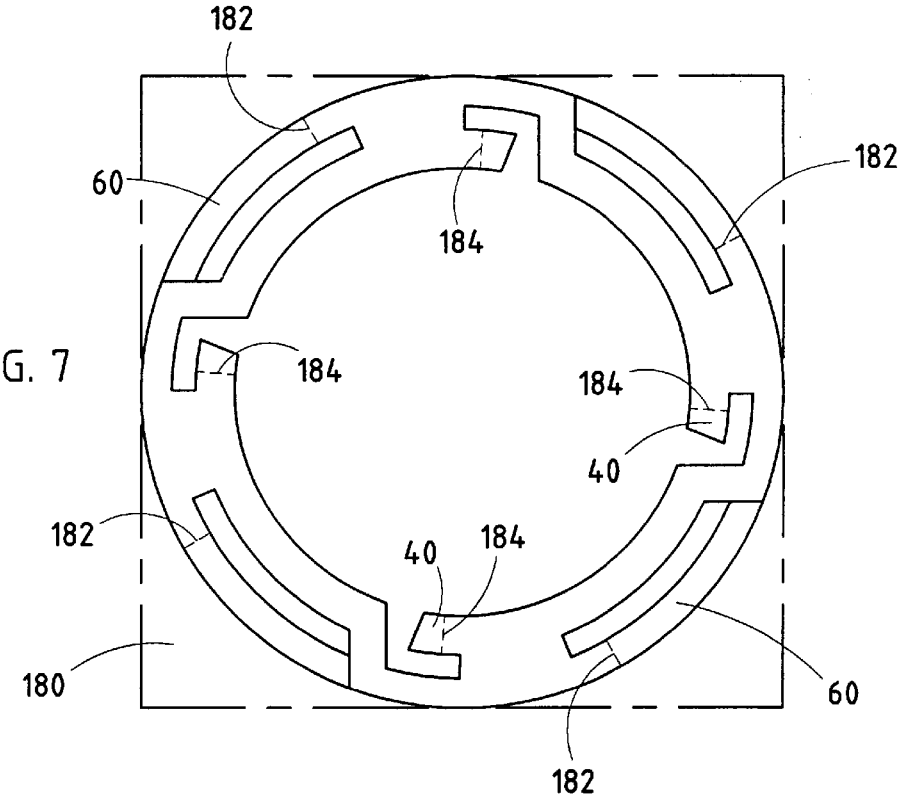
FIG. 7 is a top view of a sheet of material depicting the cut lines used in forming an escutcheon locking ring according to the present invention.

Inner section 20 of escutcheon locking ring 10 is attached to an outer section 50 by lateral members 52. Bridge members 54 are attached to outer surface 22 of inner section 20 and inner surface 51 of outer section 50. Bridge members 54 increase the strength and rigidity of escutcheon locking ring 10. Formed about outer section 50 of escutcheon locking ring 10 are a plurality of escutcheon engaging members or fingers 60. Fingers 60 depend below the horizontal plane defined by locking ring 10 and are dimensioned to engage escutcheon 150, as will be discussed in detail below. As best seen in FIGS. 2 and 7, fingers 60 are curved, such that outer surface 62 of fingers 60 define the exterior circumference of locking ring 10. Preferably, there are four fingers 60. Each finger 60 has an escutcheon engaging section, or end 64. Preferably, ends 64 are formed to have a sharp edge or surface. Sharp ends 64 permit fingers 60 to "dig into," i.e. penetrate inner surface 154 of the escutcheon 150, which is often made of a relatively soft alloy such as brass or a polymeric composition.

A shown in FIG. 7, the curvature of fingers 60 permits escutcheon locking ring 10 to be cut or otherwise formed from a single sheet of material 180 which is only slightly larger than the outer diameter of escutcheon locking ring 10 as defined by outer surfaces 62 of fingers 60. Once cut, fingers 60 are bent downward along bend line 182. Similarly tabs 40 are bent upwards along bend lines 184. In the most preferred embodiment, escutcheon locking ring 10 has an inner diameter of approximately 1.50 inches and an outer diameter of approximately 2.0 inches. Also in the most preferred embodiment, each finger 60 has a length of approximately 1.0 inch. Escutcheon locking ring 10 can be made from any material commonly employed in the art having the requisite strength and rigidity. In the most preferred embodiment, escutcheon locking ring 10 is manufactured from spring steel.

In the preferred form, circumferentially oriented fingers 60 permit fingers 60 to be formed from a given blank disc that are much greater in length than, for example, radially extending fingers. Additionally, with circumferentially oriented fingers 60, the direction of rotation of escutcheon 150 is directly against the longitude of each finger 60, as opposed to, for example, a rotational force that is applied laterally against a radially extending finger.

Figure 4:
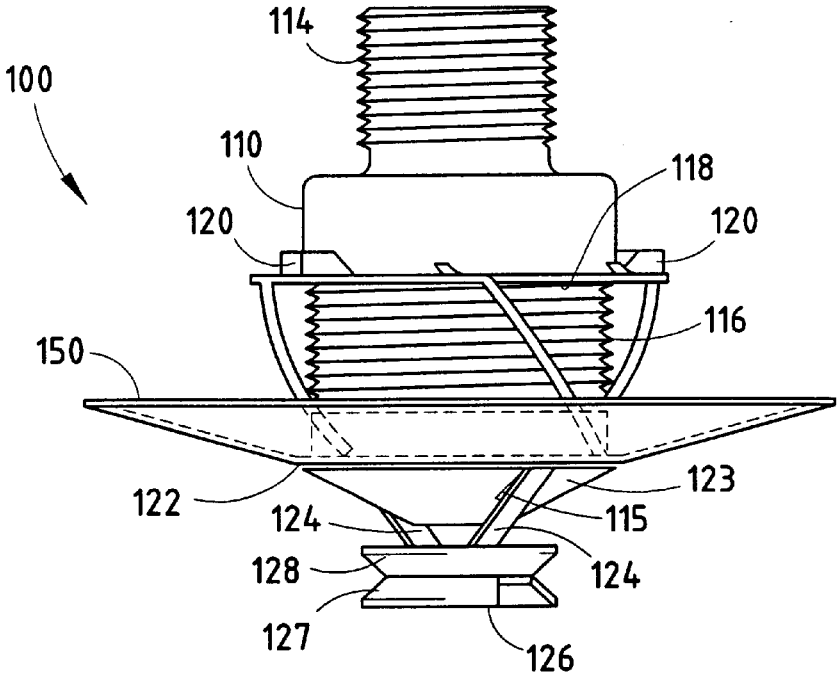
FIG. 4 is a perspective view of the locking ring, sprinkler head and escutcheon in a phantom of FIG. 3 shown in the assembled position.
Figure 5:
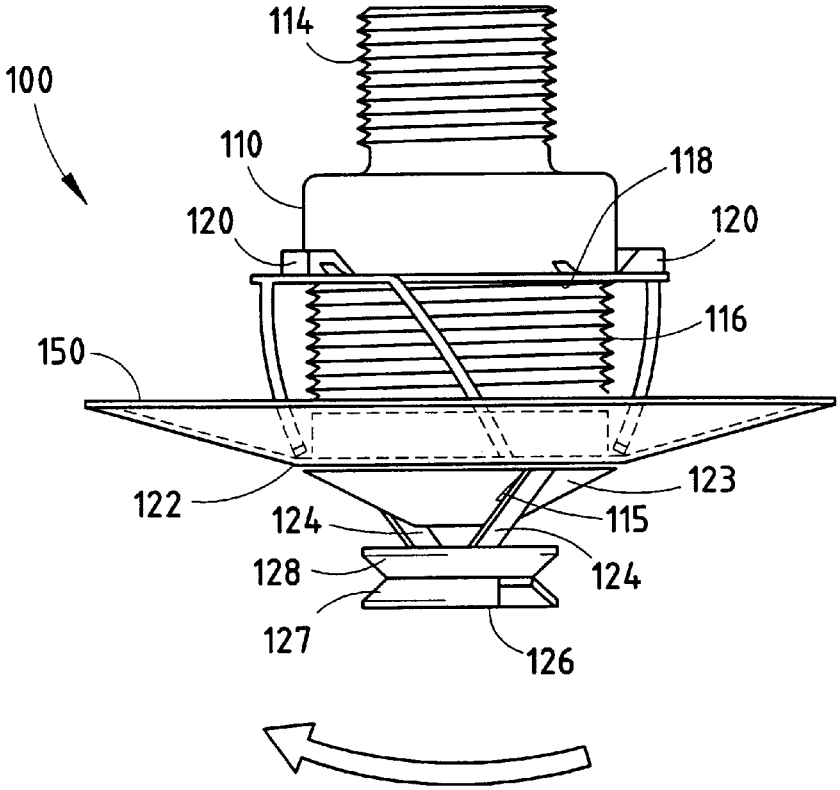
FIG. 5 is a perspective view of the assembly depicted in FIG. 4 with the escutcheon locking ring illustrated abutting the flanges of the sprinkler head.

Referring now to FIGS. 4 and 5, to employ escutcheon locking ring 10 as a positive lock to prevent the removal of escutcheon 150 from body 110 of sprinkler head 100, body 110 of sprinkler head 100 is first connected to the pressurized water pipe within the ceiling in accordance with normal industry procedure (not shown) by screwing, or otherwise placing threaded section 114 of body 110 into fluid communication with the pipe. Thereafter, escutcheon locking ring 10 is positioned around threaded section 116 with top surface 30 of escutcheon locking ring 10 being placed in abutting contact with bottom surface 121 of flanges 120. Escutcheon 150, having a set of threads 156 formed on inner surface 155, is rotated in a clockwise direction as indicated by the directional arrow in FIG. 3 onto threaded section 116 of body 110 until contact is made between surface 154 of escutcheon 150 and ends 164 of fingers 160.

Once ends 164 of fingers 160 are brought into contact with the surface 154 of escutcheon 150, an attempt to remove escutcheon 150 by rotating it in a counterclockwise direction, as indicated by the directional arrows of FIG. 5, will cause the sharp ends 64 of fingers 60 to penetrate surface 154 of escutcheon 150. When surface 154 is penetrated by ends 64, further rotation in the counterclockwise direction rotates escutcheon locking ring 10. The rotation of escutcheon locking ring 10 continues until tabs 40 are brought into abutting contact with flanges 120 positioned above top 118 of threaded section 116, as shown in FIG. 5. Once tabs 40 abuttingly contact flanges 120, further rotation in the counterclockwise direction is prohibited by frictional engagement between ends 64 of fingers 60 and inner surface 154 of escutcheon 150. This in turn provides a positive lock which prevents one from removing escutcheon 150 from sprinkler head 100.

Turning now to FIG. 6, escutcheon locking ring 10 is shown attached to a sprinkler head 170. In lieu of flanges 120, sprinkler head 170 is formed with a rim 174 positioned above threaded section 116 of sprinkler head 170. In operation, escutcheon locking ring 10 is positioned over threaded section 116 in the manner detailed above, until ends 42 of tabs 40 contact under surface 176 of rim 174. Escutcheon 150 is then rotated onto threaded section 116. Thereafter, rotation of escutcheon 150 in the counterclockwise direction as indicated by the directional arrow in FIG. 6 will result in ends 42 of tabs 40 penetrating under surface 176 of rim 174, while ends 64 of fingers 60 will penetrate inner surface 154 of escutcheon 150 thereby preventing further counterclockwise rotation of escutcheon 150.

Figure 8:
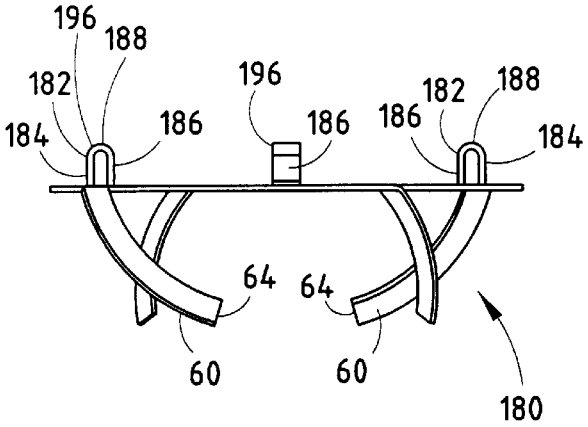
FIG. 8 is a front view of an escutcheon locking ring according to an alternative preferred embodiment of the present invention.
Figure 9:
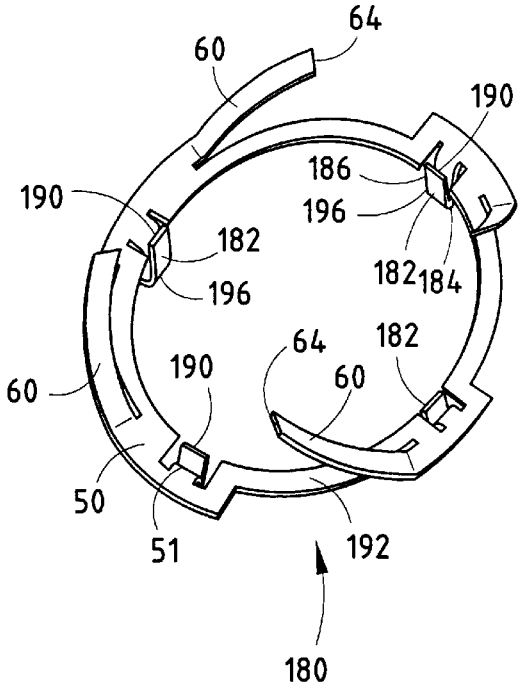
FIG. 9 is a perspective bottom view of the locking ring depicted in FIG. 8.

Referring now to FIGS. 8 and 9, there is shown an escutcheon locking ring 180 according to an alternative preferred embodiment for use in conjunction with sprinkler head 100 having flanges 120. In escutcheon locking ring 180, upwardly extending tabs 40 are replaced by U-shaped members 182 attached to inner surface 51 of outer section 50 and extending above the horizontal plane defined by locking ring 180. Each U-shaped ring 182 contains a first vertical section 184 and a second vertical section 186. Vertical sections 184 and 186 are joined by an arcuate bridge member 188. Preferably, end 190 of second vertical member 186 is approximately coplanar with bottom surface 192 of escutcheon locking ring 180.

Escutcheon locking ring 180 is attached to sprinkler head 100 containing flanges 120 in the same manner as detailed above. Once escutcheon 150 is threaded to threaded section 116 of sprinkler head 100, an attempt to remove escutcheon 150 from sprinkler head 100 by its rotation counterclockwise will cause the rotation of escutcheon locking ring 180 until surfaces 196 of U-shaped members 182 are brought into abutting contact with flanges 120 of sprinkler head 100. One such contact is achieved, further rotation causes ends 64 of fingers 60 to penetrate inner surface 154 of escutcheon 150 and thereby prohibit further rotation.

It is to be understood that the foregoing is a description of the preferred embodiments. Those skilled in the art will recognize that variations, modifications and improvements may be made without departing from the spirit and scope of the invention disclosed herein. The scope of protection afforded the present invention is to be measured by the claims which follow in the breath of interpretation which the law allows.

The embodiments of the invention in which an exclusive property or privilege is claimed are defined as follows:

1. An escutcheon locking ring for a sprinkler head having a threaded region for receiving an escutcheon, wherein the threaded region has a top having at least one engaging surface extending laterally therefrom, said locking ring comprising:

a ring surrounding the outer surface of the mounting region;

at least one escutcheon engaging member depending from said ring, said at least one escutcheon engaging member frictionally engaging the escutcheon; and at least one extending member extending from said ring, said at least one extending member engaging the at least one engaging surface extending from the top of the threaded region thereby preventing rotation of the escutcheon.

2. The escutcheon locking ring as recited in claim 1, wherein the at least one engaging surface extending from the top of the threaded region is a first flange and a second flange, and wherein said at least one engaging member is a first tab abutting the first flange and a second tab abutting the second flange.

3. The escutcheon locking ring as recited in claim 1, wherein the at least one engaging surface extending from the top of the thread region is a first flange and a second flange, and wherein said at least one extending member is a first U-shaped member abutting the first flange and a second U-shaped member abutting the second flange.

4. The escutcheon locking ring as recited in claim 1, wherein said at least one escutcheon engaging member has sharp end, said sharp end of said at least one escutcheon member penetrating the surface of the escutcheon.

5. The escutcheon locking ring as recited in claim 1, wherein said at least one escutcheon engaging member is four escutcheon engaging members.

6. The escutcheon locking ring as recited in claim 1, wherein said ring, said at least one extending member and at least one escutcheon engaging member are formed from single sheet of material.

7. The escutcheon locking ring as recited in claim 1, wherein said at least one escutcheon engaging member is curved.

8. The escutcheon locking ring as recited in claim 1, wherein said ring has an inner perimeter and an outer perimeter, wherein said at least one extending member extends from said inner perimeter of said ring.

9. The escutcheon locking ring as recited in claim 7, wherein said at least one escutcheon engaging member depends from said outer perimeter of said ring.

10. The escutcheon locking ring as recited in claim 1, wherein the at least one engaging surface extending from the top of the threaded region is a rim having an undersurface and wherein said at least one extending member has a sharp end, said sharp end of said extending member penetrating the undersurface of the engaging surface.

11. An escutcheon locking ring for a sprinkler head having a threaded mounting region for receiving an escutcheon, wherein the mounting region has a top having at least one engaging surface extending laterally therefrom, said escutcheon locking ring dimensioned to surround the mounting region, said escutcheon locking ring comprising at least one curved finger depending therefrom, said at least one curved finger having a sharp end, said sharp end frictionally engaging the escutcheon and at least one member extending from said escutcheon locking ring, whereby said at least one finger rotates said member into engagement with the at least one engaging surface of the mounting region when the escutcheon is rotated about the mounting region to thereby prevent further rotation of the escutcheon.

12. The escutcheon locking ring as recited in claim 11, wherein said escutcheon locking ring is formed from a single sheet of material.

13. The escutcheon locking ring as recited in claim 11, wherein said sharp end of said at least one curved finger penetrates the inner surface of the escutcheon.

14. The escutcheon locking ring as recited in claim 11, wherein said escutcheon locking ring has an inner perimeter and wherein said at least one curved finger is curved toward said inner perimeter.

15. The escutcheon locking ring as recited in claim 11, wherein the at least one engaging surface extending from the top of the mounting region is a first flange and a second flange, and said at least one member is a first tab and a second tab, said first tab abutting the first flange when the escutcheon is rotated and said second tab abutting the second flange when the escutcheon is rotated.

16. The escutcheon locking ring as recited in claim 11, wherein the at least one engaging surface extending from the top of the mounting region is a first flange and a second flange, and said at least one member is a first U-shaped member and a second U-shaped member, said first U-shaped abutting the first flange, said second U-shaped member abutting the second flange.

17. The escutcheon locking ring as recited in claim 11, wherein said at least one curved finger is four fingers.

18. The escutcheon locking ring as recited in claim 11, wherein the at least one engaging surface extending from the top of the mounting region is a rim having an undersurface, and wherein said at least one member as a tab having a sharp end, said sharp end of said tab penetrating the undersurface of the rim.

19. A fire sprinkler head for use with a pipe assembly in fluid communication with a fire extinguishing fluid, said fire sprinkler head comprising:

a body having a base portion in fluid communication with the water pipe assembly, a threaded mounting region positioned below said base portion, said mounting region having a top, and at least one engaging member extending laterally from said top of said mounting region;

an escutcheon threadably mounted to said mounting region; and an escutcheon locking ring surrounding said mounting region and positioned above said escutcheon, said locking ring having at least one extending member extending therefrom and at least one finger depending therefrom, said at least one finger frictionally engaging the surface of said escutcheon, whereby rotation of said escutcheon rotates said at least one extending member of said escutcheon locking ring into abutting contact with said at least one engaging member to thereby prohibit further rotation of said escutcheon.

20. The fire sprinkler head as recited in claim 19, wherein said at least one engaging member is a first flange and a second flange and wherein said at least one extending member is a first tab and a second tab, said first tab abutting said first flange, said second tab abutting said second flange.

21. The fire sprinkler head as recited in claim 19, wherein said at least one finger has a sharp end, said sharp end penetrating the inner surface of said escutcheon.

22. The fire sprinkler head as recited in claim 19, wherein said at least one finger is four fingers.

23. The fire sprinkler head as recited in claim 17, wherein said escutcheon locking ring has an inner perimeter, and wherein said at least one finger is curved toward said inner perimeter of said locking ring.

24. The fire sprinkler head as recited in claim 17, wherein said escutcheon locking ring is formed from a single sheet of material.

25. The fire sprinkler head as recited in claim 19, wherein said at least one engaging member is a first flange and a second flange, and wherein said extending member is a first U-shaped member abutting said first flange and a second U-shaped member abutting said second flange.

26. A fire sprinkler head for use with a pipe assembly in fluid communication with a fire extinguishing fluid, said fire sprinkler head comprising:

a sprinkler body having a threaded base portion in fluid communication with the pipe assembly, a threaded mounting region positioned below said base portion, said mounting region having a top and a rim extending laterally therefrom;

an escutcheon threadably mounted to said mounting region; and an escutcheon locking ring surrounding said mounting region and positioned above said escutcheon, said locking ring having at least one tab extending therefrom and at least one finger depending therefrom, said at least one finger frictionally engaging the inner surface of said escutcheon, whereby rotation of said escutcheon rotates said at least one tab of said escutcheon locking ring into frictional contact with said rim to thereby prohibit further rotation of said escutcheon.

27. The fire sprinkler head as recited in claim 26, wherein said rim has an undersurface, said at least one tab is formed with a sharp end, and wherein said sharp end of said at least one tab penetrates said undersurface of said rim.

28. The fire sprinkler head as recited in claim 26, wherein said at least one finger has a sharp end, said sharp end of said at least one finger penetrating the inner surface of said escutcheon.

29. The fire sprinkler head as recited in claim 26, wherein said escutcheon locking ring is formed of a single sheet of material.

30. The fire sprinkler head as recited in claim 26, wherein said escutcheon locking ring has an inner perimeter, and wherein said at least one finger is curved toward said inner perimeter of said locking ring.

31. The fire sprinkler head as recited in claim 26, wherein said at least one finger is four fingers.

* * * * *

UNITED STATES PATENT AND TRADEMARK OFFICE

CERTIFICATE OF CORRECTION

PATENT NO. : 6,024,177
DATED : February 15, 2000
INVENTOR(S) : Thomas E. Winebrenner It is certified that error appears in the above-identified patent and that said Letters Patent is hereby corrected as shown below:

Column 3,
Line 2, "in a phantom" should be -- (in phantom) --

Column 4,
Line 3, insert -- in -- between "skill" and "the"

Column 6,
Line 16, "mounting" should be -- threaded --
Line 24, after the word "region" insert -- , --
Line 29, "engaging" should be -- extending --
Line 34, "thread" should be -- threaded --
Line 40, insert -- a -- before "sharp" in the first occurrence
Line 41, insert -- engaging -- before "member"
Line 46, insert -- said -- between the words "and" and "at"
Line 48, insert -- a -- before "single"
Line 56, "claim 7" should be -- claim 8 --
Line 63, insert -- at least one -- between the words "said" and "extending"
Line 67, insert -- threaded -- before the word "mounting"

Column 7,
Line 2, insert -- threaded -- before the word "mounting"
Line 6, insert -- , -- after "escutcheon"
Line 8, insert -- curved -- before the word "finger"
Lines 8, insert -- at least one -- between the words "said" and "member"
Lines 9, 10, 24, and 31, insert -- threaded -- between the words "the" and "mounting"
Line 34, insert -- member -- before the word "abutting"
Line 40, insert -- threaded -- between the words "the" and "mounting"
Line 41, "as" should be -- is --
Lines 49, 51, 53, and 55, insert -- threaded -- between the words "said" and "mounting"
Line 57, insert -- escutcheon -- before the word "locking"

UNITED STATES PATENT AND TRADEMARK OFFICE

CERTIFICATE OF CORRECTION

PATENT NO. : 6,024,177
DATED : February 15, 2000
INVENTOR(S) : Thomas E. Winebrenner It is certified that error appears in the above-identified patent and that said Letters Patent is hereby corrected as shown below:

Column 8,
Line 16, insert -- escutcheon -- before the word "locking"
Line 22, insert -- at least one -- between the words "said" and "extending"
Lines 31, 33, and 35, insert --threaded -- betweeen the words "said" and "mounting"
Line 37, insert -- escutcheon -- before the word "locking"

Signed and Sealed this

Thirteenth Day of November, 2001

*Attest:*

Nicholas P. Godici

NICHOLAS P. GODICI
*Acting Director of the United States Patent and Trademark Office*

*Attesting Officer*